US006022168A

United States Patent [19]

Junker

[11] Patent Number: 6,022,168

[45] Date of Patent: Feb. 8, 2000

[54] APPARATUS FOR SHIFTING GUIDING BARRIERS RESTING ON A STREET SURFACE

[76] Inventor: Wilhelm Junker, Postfach 1130, 71501 Backnang, Germany

[21] Appl. No.: 08/890,086

[22] Filed: Jul. 9, 1997

[30] Foreign Application Priority Data

Jul. 3, 1997 [DE] Germany ..... 2971167 U

[51] Int. Cl.[7] ..... E01F 15/04

[52] U.S. Cl. ..... 404/6; 404/9; 404/12

[58] Field of Search ..... 404/6, 9, 12, 84.5; 254/88; 414/791.1; 280/5.22

[56] References Cited

U.S. PATENT DOCUMENTS

| | | | |
|---|---|---|---|
| 4,017,200 | 4/1977 | Woods, Jr. | 404/6 |
| 4,142,625 | 3/1979 | Bourgeois | 198/570 |
| 4,500,225 | 2/1985 | Quittner | 404/6 |
| 4,676,688 | 6/1987 | Caradot | 404/91 |
| 5,074,101 | 12/1991 | Rewitzer | 53/436 |
| 5,546,123 | 8/1996 | Ikeda et al. | 404/84.5 |

*Primary Examiner*—Thomas B. Will
*Assistant Examiner*—Raymond W Addie
*Attorney, Agent, or Firm*—Jordan and Hamburg LLP

[57] ABSTRACT

An apparatus permits guiding barriers resting on a street surface in the form of a track to be laterally shifted. The apparatus is fastened to a vehicle, and is moved along, together with the vehicle, in the longitudinal direction of the guiding barriers. The apparatus includes a guideway which has a curved portion extending behind the vehicle, such that a front portion of the guideway is laterally offset from a trailing portion thereof. The guideway has a generally U-shaped cross-section, upright legs of which guide the sides of the guiding barriers passing therethrough. A blade, disposed at the front end of the guideway, initially moves under the first guiding barrier. The first guiding barrier and the subsequent barriers constituting the track are pushed over the guideway, into a position which is offset laterally to the original position, and placed down again on the surface of the street. When the end of the track which is to be shifted is reached by the moving apparatus, the guiding barriers are pulled over the guideway by the previously shifted portion of the track, which has already been brought into its new resting position on the street surface.

12 Claims, 2 Drawing Sheets

APPARATUS FOR SHIFTING GUIDING BARRIERS RESTING ON A STREET SURFACE

BACKGROUND OF THE INVENTION

The invention relates to an apparatus for shifting guiding barriers resting on a street surface in the form of a track.

Guiding barriers are used in various applications in order to mark altered traffic flows, for example, at building sites. Typically, a track, composed of several guiding barriers, is used for this purpose. The guiding barriers are connected with one another in a manner resisting compression and tension, and coupled to permit mutual swiveling of the guiding barriers in a horizontal plane in order to allow curved placement of the guiding barrier.

When the traffic flow changes, realignment of the guiding barriers is necessary, requiring shifting thereof from one position into a new parallel position. Until now, this has been done by shifting the guiding barriers by hand. In accordance with this prior art approach, the guiding barriers are detached manually from the track, brought into the new position and there assembled once again into a track. The effort involved is considerable, and leads to work delays which cannot be justified economically. In addition, the personnel performing the shifting operation are placed in danger by the traffic.

It is therefore an object of the invention to simplify the shifting of guiding barriers and to make the process more cost-effective.

SUMMARY OF THE INVENTION

In accordance with these and other objects of the invention, there is provided a shifting apparatus for realignment of guiding barriers resting on a street surface and disposed in the form of a track. The shifting apparatus includes a guideway which is U-shaped in cross section and is fastened detachably at the side of a vehicle. The guideway includes a front part and an end part which is offset laterally with respect to the front part, such lateral offsetting being produced by a curved part of the guideway. A ramp-shaped pickup blade is provided at a front end of the guideway, and rollers are disposed at the bottom of the guideway for facilitating transfer of the guiding barriers along the guideway.

Pursuant to the invention, guiding barriers of the aforementioned type are shifted by an apparatus fastened to a vehicle, which reduces the required work force for the shifting operation to only two persons. The shifting is implemented by means of a guideway, which is moved, together with the vehicle, in the longitudinal direction of the guiding barriers. A blade, disposed at the front end of the guideway, initially moves under the first guiding barrier. The first guiding barrier and the subsequent barriers constituting the track are pushed over the guideway, which has a curved portion extending behind the vehicle, into a position which is offset laterally to the original position, and finally placed down again on the surface of the street. At the end of the track which is to be shifted, the guiding barriers are pulled over the guideway by the previously shifted portion of the track, which has already been brought into its new resting position. The upright legs of the guideway, which is U-shaped in cross section, guide the sides of the guiding barriers.

Appreciable time and money is saved by shifting the guiding barriers mechanically instead of by hand, the costs being reduced by about 70%. In addition, the danger to road users and to personnel is reduced to a minimum.

A particularly advantageous embodiment is directed use in shifting guiding barrier having rubber stoppers disposed on the undersides thereof for preventing slippage of the guiding barriers on the surface of the street. In accordance with the embodiment, a roller of small diameter is advantageously provided in front of the pickup blade in order to preclude any damage to these rubber stoppers. Such placement of the roller prevents the cutting edge of the pickup blade from striking the rubber stopper.

The above, and other objects, features and advantages of the present invention will become apparent from the following description read in conjunction with the accompanying drawings, in which like reference numerals designate the same elements.

DETAILED DESCRIPTION OF THE INVENTION

Figure 1:
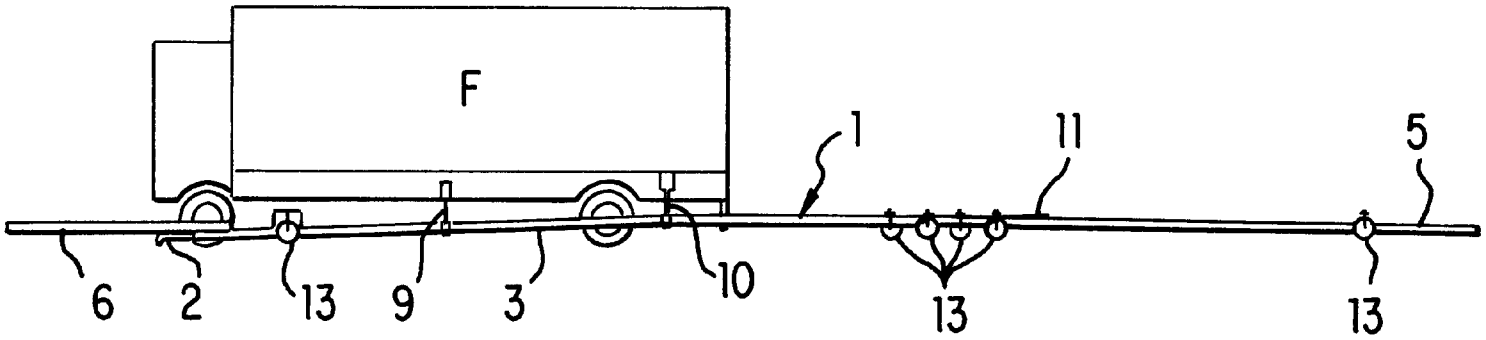
FIG. 1 is a side view of a guideway in accordance with an embodiment of the invention, which is connected with a vehicle.

A guideway 1 is fastened detachably to a side of a vehicle F, and is moveable in response thereto. The guideway 1 presents a low U-shaped cross sectional configuration, upwardly protruding U legs thereof functioning as lateral guides for guiding barriers (not shown) transported on the guideway 1. The guideway 1 is equipped with rollers 12 disposed in a bottom position thereon, and which run on ball bearings thereby permitting the guiding barriers to be moved easily along the guideway 1.

The guideway 1 includes a pickup blade 2 disposed at a front end thereof. A straight segment 3 of the guideway 1 adjoins the pickup blade 2 over a plug-in connection 16. An arched segment 4 connects with the straight segment 3 of the guideway 1. A straight intermediate segment 7 is connected to the arched segment 4, which in turn connects to a second arched segment 8 having an opposite curvature to the arched segments 4. The above segments 3, 4, 7, 8, which in aggregate form the guideway 1, are connected to one another by plug-in connections secured by bolts. The arched segments 4 and 8 subtend an angle of about 60°.

The straight segment 3 is connected detachably to the vehicle F by holding devices 9 and 10. The holding devices 9 and 10 are inserted into U-shaped adapters, which are mounted at the side of the vehicle F, and secured in this position by bolts.

An aiming mechanism 6 is provided in the form of a rod, positioned alongside the pickup blade and protruding forwards by some meters. A specified marking, located about 5 cm next to the guiding barrier that is to be picked up, is scanned by the aiming mechanism 6. The aiming mechanism 6 thereby provides information helpful in properly steering the vehicle F in such direction that the guiding barriers are conveyed into the correct position on the pickup blade 2 and, subsequently, onto the guideway 1. After the vehicle F is moved into position, the aiming mechanism 6 is inserted and secured.

Figure 3:
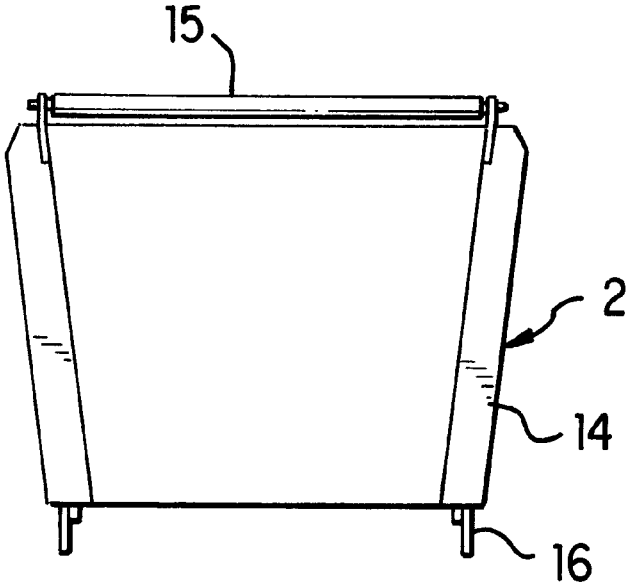
FIG. 3 is a plan view of a pickup blade in accordance with an embodiment of the invention.
Figure 4:
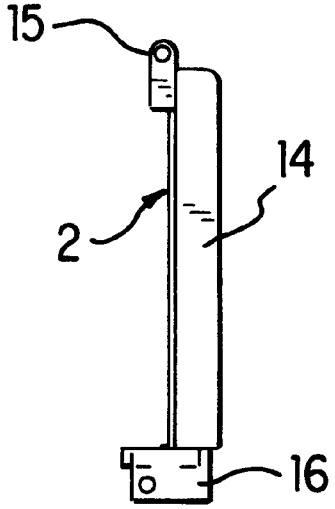
FIG. 4 is an elevational view of the pickup blade embodiment of FIG. 3.

The pickup blade 2, which is constructed in the form of a ramp (see FIGS. 3 and 4). The width of the pickup blade 2 increases towards a front end thereof, and includes guiding plates 14 at opposed sides thereof and a roller 15 at the front end. The roller 15 protects the rubber stoppers at the underside of the guiding barrier from damage during transfer thereof from the street surface to the guideway 1. In addition, when the pickup blade 2 is seated on uneven ground, it is prevented by the roller 15 from catching or being abraded severely frictional contact therewith. The pickup blade 2 is connected with the straight segment 3 by a fully floating axle with cotter pin.

Figure 5:
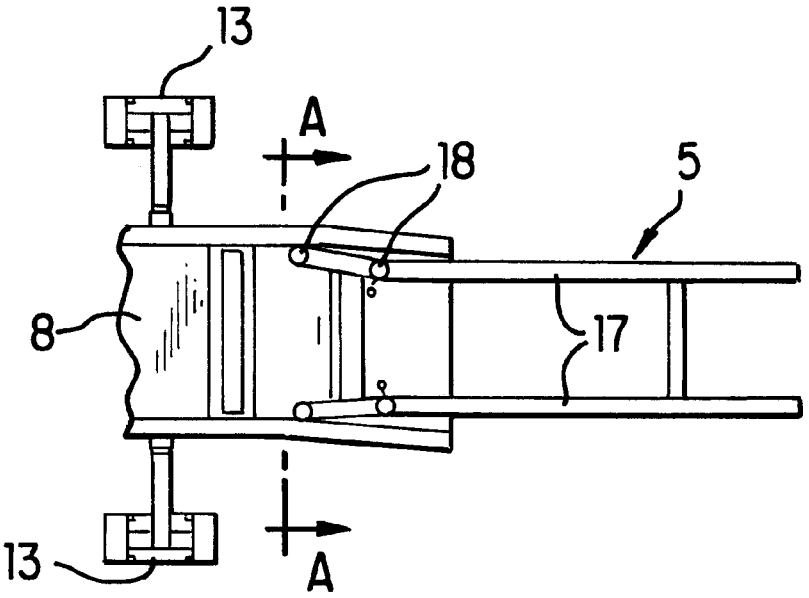
FIG. 5 is a plan view of a steering mechanism in accordance with an embodiment of the invention, disposed at the end of the guideway.
Figure 6:
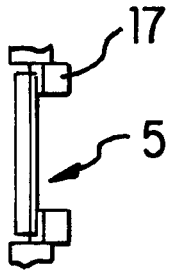
FIG. 6 is a cross-sectional view taken along line A—A of FIG. 5.

A steering mechanism 5 is provided at the trailing end of the guideway 1 by means of which the arc-shaped movement of the guiding barriers is converted into a straight movement. Operation of the steering mechanism 5 assures that the guiding barriers are placed down accurately. The steering mechanism 5 (see FIGS. 5 and 6), which consists essentially of straight side guides 17, can be brought over joints into different positions and adjusted to different track widths and locked there with bolts.

Figure 2:
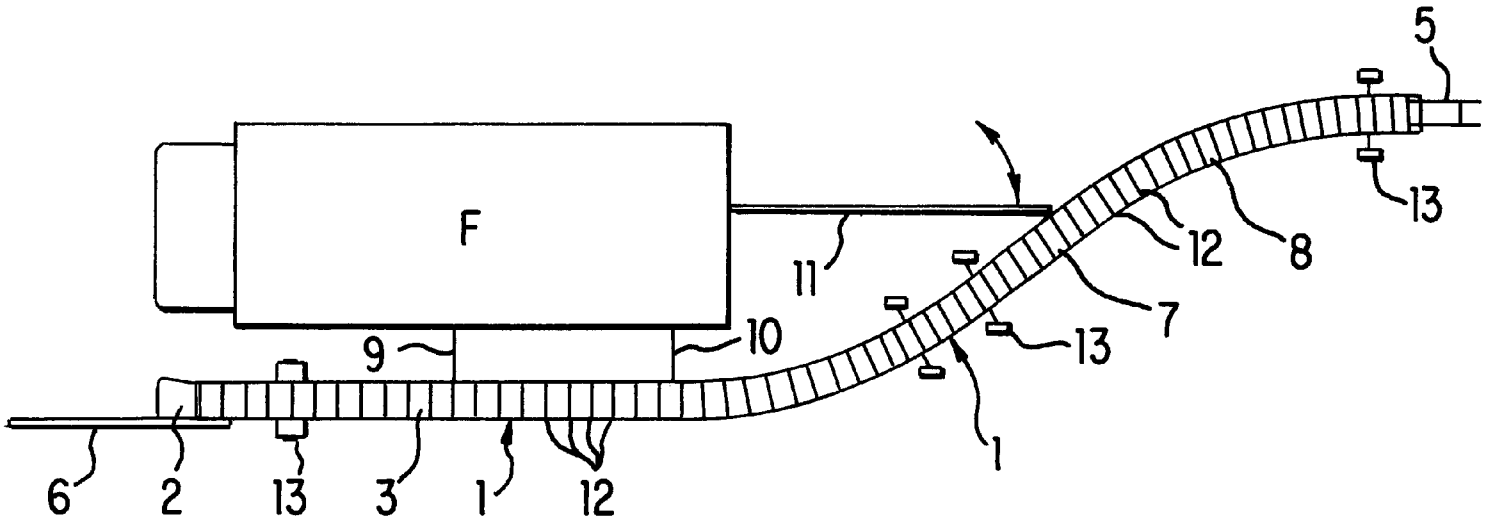
FIG. 2 is a plan view the embodiment of FIG. 1.

Bogie wheels 13 are mounted over the length of the guideway 1, extending outwardly of the sides thereof. Suitable means are provided for permitting vertical adjustment of the bogie wheels 13 relative to the guideway 1 to thereby selectively control a height of the guideway above the street surface, and for permitting the bearings of the bogie wheels 13 to be rotated about a vertical axis and locked in a specified position. This latter feature, which permits correct orientation of bogie wheels 13 relative to a driving direction, as shown in FIG. 2, is particularly applicable to the bogie wheels 13 which are mounted at the second arched segment 8 and are locked with cotter pins in the driving direction during the operation of the shifting apparatus. During assembly of the apparatus, the cotter pins can be pulled, so that the second arched segment 8 can be easily moved.

The curved portion of the guideway 1 is connected via a centering rod 11 with the vehicle F, this connection being conveniently accomplished by means of an adapter with bolt which has been screwed on. The centering rod 11 immediately pulls the trailing portion of the guideway when the vehicle F begins to move, thereby preventing deflection of the guideway 1 and maintaining the correct travel path thereof.

The extent of the lateral shifting of the guiding barriers is between about 2.3 m and 4 m, which distance can be varied by selection of an appropriate length of the straight intermediate segment 7 which is inserted between the arched segments 4 and 8. When the straight intermediate segment 7, which is composed of one or more individual sections, is short or absent, the extent of the shifting is at the lower limit noted above. Conversely, shifting to the extent of about 4 m can be attained when a long intermediate segment 7 is used.

The above-described apparatus for shifting is operated in the manner outlined below.

For proper operation of the apparatus in accordance with the invention, a track of guiding barriers, which is possibly continuous, must be arranged in a manner permitting the pickup blade 2 to be introduced below a first guiding barrier of the track. When the vehicle F starts to move, the track of guiding barriers is pushed over the pickup blade 2 onto the guideway 1. After it has passed through the curved portion of the guideway 1, the track is laid down again in another position laterally shifted with respect to the pickup position. As noted previously herein, the guiding barriers permit lateral articulation relative to one another in order to make an arc-shaped movement of the track possible.

In an advantageous embodiment, vertical adjustment of the bogie wheels 13 optionally permits the guideway to be sufficiently raised above the street surface such that the shifting apparatus can be equipped to convey the guiding barriers over a guide board presently installed on the street to the other side of the street.

For the example described above, the guiding barriers are transported over the rollers 12 disposed at the bottom of the guideway 1. However, with the shifting apparatus in accordance with the invention, individual pivot feet can also be brought from one position to the other by means of an endless belt disposed at the bottom of the guideway 1. The endless belt, which preferably is driven, consists of a tear-resistant, weather-resistant, elastic material, particularly of rubber.

Having described preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

I claim:

1. A shifting apparatus for laterally moving guiding barriers resting on a street surface and disposed in the form of a track, the shifting apparatus comprising:

a guideway presenting a generally U-shaped cross-sectional shape, the guideway having a front part and an end part which is offset laterally with respect to the front part, the lateral offsetting being brought about by a curved part;

mounting structure for detachably fastening the guideway to the vehicle such that at least a portion of the front part of the guideway extends alongside the vehicle with a front end thereof positioned a significant distance forward a rear of the vehicle, the mounting structure including supports for securing the portion of the front part of the guideway to a facing side of the vehicle and for maintaining same at a fixed distance from the vehicle, the end part of the guideway extending behind the rear of the vehicle and at least partially laterally crossing a path of the vehicle;

a ramp-shaped pickup blade disposed at the front end of the guideway and positioned for contacting the street surface, the pickup blade transferring the guiding barriers onto the guideway when the guideway is moved forward along with the vehicle;

rollers disposed at the bottom of the guideway for supporting the guiding barriers as they pass through the guideway; and bogie wheels mounted on the guideway for contacting the street surface and providing cleared support of the guideway above the street surface.

2. The shifting apparatus of claim 1, further comprising:

a centering rod for connecting the guideway with the vehicle, a first end of the centering rod being receivable on the vehicle in a position in which the centering rod extends rearwardly from the vehicle, a second end of the centering rod being connectable to the guideway at the curved part thereof.

3. The shifting apparatus of claim 1, wherein bearings of the bogie wheels are mounted for rotation about a vertical axis perpendicular to a rotational axis of the bogie wheels and are lockable in a particular rotational position about the vertical axis to permit selection of a desired orientation of the bogie wheels relative to a driving direction.

4. The shifting apparatus of claim 1, wherein:

the curved part includes a straight intermediate segment interposed at an angle relative a driving direction of the vehicle between two arched segments having opposite curvature, the extent of the shifting being selectable by one of varying the length of the straight intermediate segment and by the omission of the straight intermediate segment.

5. The shifting apparatus of claim 1, further comprising:

a roller disposed in front of the pickup blade for minimizing damage to the rubber stoppers disposed at the underside the guiding barrier during transfer thereof from the street surface to the guideway.

6. The shifting apparatus of claim 1, wherein the rollers disposed at the bottom of the guideway are mounted in the direction of the radius of curvature and are closer together in a curved region of the guideway.

7. The shifting apparatus of claim 1, further comprising:

a steering mechanism disposed at an end of the guideway for laying down the guiding barriers; and a mechanism for locking the steering mechanism in various positions.

8. The shifting apparatus of claim 1, further comprising:

an aiming mechanism, the aiming mechanism including a forwardly protruding rod disposed at a side of the pickup blade, the aiming mechanism including means for scanning a marking disposed next to the guiding barrier that is to be picked up to provide information helpful in properly steering the vehicle in such direction that the guiding barriers are conveyed into the correct position on the pickup blade.

9. The shifting apparatus of claim 1, wherein said front end is proximate a forward portion of the vehicle when the guideway is fastened thereto.

10. A shifting apparatus for guiding barriers resting on a street surface and disposed in the form of a track, the shifting apparatus comprising:

a guideway which is U-shaped in cross section and is fastened detachably at the side of a vehicle, the guideway having a front part and an end part which is offset laterally with respect to the front part, the lateral offsetting being brought about by a curved part thereof;

a ramp-shaped pickup blade disposed at a front end of the guideway;

rollers disposed at the bottom of the guideway;

bogie wheels mounted on the guideway for contacting the street surface and providing elevated support of the guideway above the street surface; and the guideway consisting of a plurality of discrete straight and curved segments securably connectable to one another by mutually cooperative structure providing plug-in connections.

11. A shifting apparatus for guiding barriers resting on a street surface and disposed in the form of a track, the shifting apparatus comprising:

a guideway which is U-shaped in cross section and is fastened detachably at the side of a vehicle, the guideway having a front part and an end part which is offset laterally with respect to the front part, the lateral offsetting being brought about by a curved part thereof;

a ramp-shaped pickup blade disposed at a front end of the guideway;

rollers disposed at the bottom of the guideway;

bogie wheels mounted on the guideway for contacting the street surface and providing elevated support of the guideway above the street surface; and a mechanism for adjusting a vertical displacement between the guideway and a particular one of the bogie wheels whereby a height of the guideway above the street surface can be selectively controlled.

12. The shifting apparatus of claim 11, wherein the mechanism for adjusting the vertical displacement for each of the bogie wheels located in a central region of the guideway permits adjustment by an amount sufficient to enable the guideway to clearingly cross over a guide board disposed on the street surface and oriented between an original position of the guiding barriers and a laterally offset relocated position.

* * * * *